United States Patent [19]

Yamada et al.

[11] 4,119,461

[45] Oct. 10, 1978

[54] PHOTOSENSITIVE MATERIAL FOR ELECTROPHOTOGRAPHY COMPRISING A SILICON OIL

[75] Inventors: Yutaka Yamada; Akira Kato; Tohru Uchida, all of Hachioji, Japan

[73] Assignee: Konishiroku Photo Industry Co., Ltd., Tokyo, Japan

[21] Appl. No.: 788,254

[22] Filed: Apr. 18, 1977

Related U.S. Application Data

[63] Continuation of Ser. No. 553,112, Feb. 26, 1975, abandoned, which is a continuation-in-part of Ser. No. 426,936, Dec. 13, 1973, abandoned.

[30] Foreign Application Priority Data

Dec. 18, 1972 [JP] Japan ..... 47-126218

[51] Int. Cl.[2] ..... G03G 5/08; G03G 5/04; G03G 13/00; H01C 13/00

[52] U.S. Cl. ..... 96/1.8; 96/1.5; 96/1; 252/501

[58] Field of Search ..... 96/1, 1.5, 1.8; 252/501

[56] References Cited

U.S. PATENT DOCUMENTS

| | | | |
|---|---|---|---|
| 3,132,941 | 5/1964 | Stahly et al. | 96/1 |
| 3,775,115 | 11/1973 | Sorkin et al. | 96/1.8 |

*Primary Examiner*—Edward C. Kimlin
*Assistant Examiner*—L. Falasco
*Attorney, Agent, or Firm*—Bierman & Bierman

[57] ABSTRACT

A photosensitive material of the binder type for electrophotography having a photosensitive layer of the material comprising a silicon oil having a viscosity of at least 6000 cs when measured at 25° C.

3 Claims, No Drawings

PHOTOSENSITIVE MATERIAL FOR ELECTROPHOTOGRAPHY COMPRISING A SILICON OIL

This is a Rule 60 Continuation application of Ser. No. 553,112 filed on Feb. 26, 1975 and now abandoned which itself is a continuation-in-part application of Ser. No. 426,936 filed on Dec. 13, 1973 and now abandoned and which claims the priority of Japanese patent application No. 126,218 filed on Dec. 18, 1972.

This invention relates to a reusable photosensitive material having an electrophotographic photosensitive layer of the binder type. Known electrophotographic methods are generally classified into two main categories. The first is the non-transfer method comprising forming an electrostatic image on photosensitive layer, developing the electrostatic image to form a visible toner image and directly fixing the visible toner image on the photosensitive layer without any transference of the toner image to another image carrier (such as a paper sheet). The second is the transfer method comprising forming an electrostatic image on a photosensitive layer, developing the electrostatic image to form a visible toner image on the photosensitive layer, transferring the toner image onto another image carrier and fixing the transferred image thereon. In the latter method, a selenium vacuum-deposited film or a so-called binder type photosensitive layer containing a photoconductive powder such as zinc oxide dispersed in a binder is employed as the photosensitive layer. This type of photosensitive layer has certain disadvantages.

If the layer is used repeatedly many times, the surface of the photosensitive layer is damaged by frictional contact with the developing brush, the cleaner brush, the transferring material and the like. This results in the photoconductive substance peeling off the surface of the photosensitive layer. The thus damaged layer causes harm to the uniform dispersion state of the photoconductive substance, and hence induces such undesired phenomena as reduction of the copy density and formation of fog. Further, the toner readily adheres to the damaged portion of the photosensitive layer and a film of toner is formed thereon as a result. Accordingly, conventional photosensitive layers of binder type are not suitable for repeated use.

This invention is intended to overcome these defects in conventional photosensitive layers of the binder type.

As an indication of a typical prior art concept, there can be mentioned a technique disclosed in Japanese Patent Publication No. 28037/69. According to that disclosure, a layer of a cured silicone releasing agent having a low adhesive force is formed. At page 2, lower column, line 4, said patent publication teaches that a polymethylsiloxane having terminal —OH groups is used in combination with a curing agent to form a tough film which is soluble in a solvent with difficulty and has releasing properties. However, as is described on page 3, column 6 of said patent publication, the silicone releasing agent layer is sometimes triboelectrically charged and consequently causes fog.

The photosensitive layer according to this invention has none of these defects, even when the development is carried out by the cascade method, the magnetic brush method or the like. In this invention, a silicone oil having a viscosity of at least 6000 cs when measured at 25° C is incorporated into a photosensitive layer of the binder type. If a silicone oil having a viscosity lower than 6000 cs at 25° C (low viscosity silicon oil) is used, it is transferred to the toner transfer paper or cleaning brush during operation, and the intended effect could not be obtained. More specifically, if the photosensitive layer is repeatedly used, the surface quality of the layer will deteriorate during development, transferring and cleaning, resulting in degradation of the image quality.

In contrast, when high viscosity silicone oil is used according to this invention, the frictional resistance on the surface of the photosensitive layer is much reduced. Hence, the resistance to wear during cleaning is improved and the formation of a film of toner is minimized. Simultaneously, the transferability of the toner to the transfer paper is also improved. Moreover, occurrence of electrical defects during the repeated use is greatly reduced resulting in obtaining an image of high quality while, at the same time, minimizing the damage to the surface of the photosensitive layer.

A preferred oil is represented by the following formula:

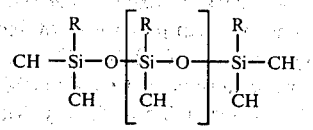

Wherein R is methyl or phenyl, and $n$ is 700 to 2500. As typical instances of a commercially available silicone oil having a viscosity of more than 6000 cs at 25° C, there can be cited Shinetsu Silicone KF96H (Dimethylpolysiloxane produced by Shinetsu Kagaku), Toray Silicone SH200 (Dimethylpolysiloxane produced by Toray Silicone) and Toshiba Silicone TSF 451 (Dimethylpolysiloxane produced by Toshiba Silicone). The silicone oil can be incorporated into the photosensitive layer in various known ways. For example, the silicone oil is added to a photosensitive layer-forming composition prior to formation of the layer. Alternately after formation of a photosensitive layer, a solution of the silicone oil in a solvent such as Isopar H (product of Esso Standard Co.) is coated on the photosensitive layer by the so-called dip method, spray method or the like. In general, the silicone oil is incorporated in an amount of 0.1 to 5% by weight based on the total dry weight of the components of the photosensitive layer. Silicone oils having a viscosity of at least 6000 cs at 25° C have no bad influences on the photographic characteristics of the photographic material.

The photosensitive layer of this invention is of the binder type, and this invention is applicable to any known photosensitive layer of the binder type formed by dispersing a photoconductive substance such as zinc oxide, cadmium sulfide, zinc sulfide or titanium dioxide into a binder such as an alkyd resin, an epoxy resin, an acrylic resin, a silicone varnish, or a copolymer of at least one of these resins with at least one other monomer. Sensitizing dyes such as rose bengal, bromophenol blue and fluorescein can be incorporated into the photosensitive layer.

According to this invention, a silicone oil having a high viscosity of at least 6000 cs at 25° C is incorporated into a photosensitive layer of the binder type such as mentioned above. Since no silicone film is formed on the surface of the photosensitive layer, a memory effect is not caused even when a photoconductive substance such as zinc oxide, which substance readily causes a memory effect in conventional photosensitive layers, is employed. This invention will now be illustrated in more detail by the following Examples:

EXAMPLE 1

A barrier layer comprising casein was formed on an aluminum-laminated paper support, and 30g/m$^2$ of the following photosensitive layer-forming composition coated thereon to produce a photosensitive material for electrophotography.

| Photosensitive Layer-Forming Composition | |
|---|---|
| (all parts are by weight) | |
| Zinc oxide | 100 parts |
| Acrylic resin | 20 parts |
| Rose Bengal (2% solution in methanol) | 2 parts |
| Silicone oil (Shinetsu Silicone KF 96 H viscosity - 100,000 cs at 25° C) | 2 parts |
| Toluene | 150 parts |

For comparison tests the same photosensitive material as above was prepared except that the silicone oil was omitted. The two samples thus obtained were reused 1000 times by the U-BIX 480 (electrographic copying machine manufactured by Konishiroku Photo Industry Co., Ltd.) and the copy density, fog and image roughness were determined and the results shown in Table 1.

Table 1

| | Comparative Sample | Sample of This Invention |
|---|---|---|
| Maximum copy density (after repeating copying operation 1000 times) | 0.3 | 0.7 |
| Fog (after repeating copying operation 1000 times) | 0.05 | 0.01 |
| Image roughness (after repeating copying operation 1000 times) | extreme | very low |

In the table 1, the copy density is a reflective density measured by Sakura Densitometer PDA 30 manufactured by Konishiroku Photo Industry Co., Ltd.

EXAMPLE 2

The following photosensitive composition was coated on a barrier layer formed on an aluminum laminated paper support at a weight of 35 g/m$^2$ (all parts are by weight):

| | |
|---|---|
| Zinc oxide | 100 parts |
| Alkyd resin | 20 parts |
| Fluorescein (20% solution in methanol) | 2 parts |
| Toluene | 150 parts |

Then, a 2% solution of silicone oil (Shinetsu Silicone KF 96 H(viscosity — 100,000 cs at 25° C) in Isopar H (manufactured by Esso Standard Co.) was spray coated on the photosensitive layer and dried. When the sample was tested in the same manner as in Example 1, results similar to those shown in Table 1 were obtained.

What is claimed is:

1. A photosensitive material for electrophotography having a binder type photosensitive layer containing photoconductive materials of the inorganic type comprising a silicon oil having a viscosity of at least 6,000 cs when measured at 25° C. said silicon oil being represented by the following general formula:

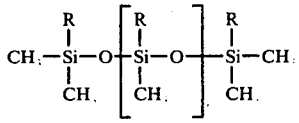

wherein R is methyl or phenyl, and $n$ is 700 to 2500.

2. A photosensitive material for electrophotography according to claim 1 wherein said photosensitive layer comprises at least one additive taken from the class consisting of zinc oxide, cadmium sulfide, zinc sulfide, titanium dioxide.

3. A photosensitive material for electrophotography according to claim 2 wherein said layer further comprises a resin binder in which said additive is dispersed.

* * * * *